US005494111A

United States Patent [19]

Davis et al.

[11] Patent Number: 5,494,111

[45] Date of Patent: Feb. 27, 1996

[54] PERMANENT WHIPSTOCK

[75] Inventors: John P. Davis, Cypress; Gerald D. Lynde, Houston; Mark H. Lee, Spring, all of Tex.; Arthur G. Alexander, Shreveport, La.

[73] Assignee: Baker Hughes Incorporated, Houston, Tex.

[21] Appl. No.: 242,165

[22] Filed: May 13, 1994

[51] Int. Cl.[6] ..... E21B 7/08; E21B 23/00

[52] U.S. Cl. ..... 166/382; 166/117.6; 166/217; 175/81

[58] Field of Search ..... 166/117.6, 117.5, 166/382, 217; 175/81, 78, 79, 61, 62

[56] References Cited

U.S. PATENT DOCUMENTS

| | | | |
|---|---|---|---|
| 1,812,880 | 7/1931 | Kinzbach et al. | 166/117.6 |
| 1,821,426 | 9/1931 | Dumm et al. | 166/117.6 X |
| 2,105,722 | 1/1938 | Brrrett et al. | 175/81 |
| 2,170,284 | 8/1939 | Eastman | 166/117.6 |
| 2,401,893 | 6/1946 | Williams, Jr. | 166/117.6 X |
| 2,445,100 | 7/1948 | Wright | 166/117.6 |
| 2,699,920 | 1/1955 | Zublin | 175/81 |
| 5,035,292 | 7/1991 | Bailey et al. | 175/75 X |
| 5,222,554 | 6/1993 | Blount et al. | 166/117.6 |
| 5,361,833 | 11/1994 | Schock et al. | 166/117.6 |

OTHER PUBLICATIONS

ARCO Drawing Figures A & B (Undated).

*Primary Examiner*—Stephen J. Novosad

*Attorney, Agent, or Firm*—Fishman, Dionne & Cantor

[57] ABSTRACT

This invention relates to a permanent whipstock assembly which uses camming pivot arms to secure the whipstock at the desired location within a cased wellbore. Camming pivot arms are pivotally attached to the downhole end of a whipstock housing and are further attached to a slip pad. Intentionally induced relative movement of the slip pad and the whipstock housing causes the camming pivot arms to pivot in such a manner that slip pad housing 4 and slip pad 5 are forced away from each other and cammed into the cased borehole. The invention relates specifically to a device that is particularly adapted to be lowered through a small diameter and later to be activated and set in a much larger casing or hole diameter.

34 Claims, 5 Drawing Sheets

PERMANENT WHIPSTOCK

BACKGROUND OF THE INVENTION

1. Field of the Invention

The invention relates to a permanent whipstock for use downhole in a wellbore.

2. Prior Art

For many years whipstock assemblies have been used to deflect drillstrings around obstructions in a formation or in a previously completed casing. Whipstock have been used with great success, however, normally require several trips and a number of separate parts.

Generally, to employ a whipstock assembly to deflect a drillstring, the whipstock assembly must be supported. Supports for whipstocks are most commonly in the form of packers. Packers have been designed in many different ways over the years and have performed their intended function satisfactorily but most require they be run in the hole separately or that complex apparati and multiple steps be used to set the packer and whipstock on the same run-in of the workstring. Examples of such packers and whipstock/packer assemblies include Baker DW-1 packer/anchor and whipstock assembly.

While the above methods and apparati for supporting a whipstock are functional, they are expensive, either because of complexity or because of the need to remove the workstring. Therefore a need exists for a permanent whipstock assembly which does not require a packer and which can be fully and securely set in one run-in of the workstring.

SUMMARY OF THE INVENTION

The above-discussed and other drawbacks and deficiencies of the prior art are overcome or alleviated by the permanent self camming whipstock of the invention.

The permanent self camming whipstock of the present invention comprises a tapered face for diverting a drillstring, said face being held in desired position by diverging camming pivot arms positioned at the lower end thereof. The system has conventional electrically activated Pressure Setting Actuator (PSA) which allows the whipstock to be set anywhere in a cased hole environment. The system eliminates the need for a set down weight as a preset anchor as most prior art whipstock assemblies require. Essentially, the whipstock of the present invention is permanently settable in one trip downhole.

A setting sleeve and various connecting rods are advantageously positioned to pull the pivot arms into a set position, thus forcing a slip pad against a casing of a borehole and thereby cam the whipstock in place. Moreover, the various connecting rods are attached with screws, in a two piece shear block assembly, which are shearable a given tensile force. As the workstring pulls upward, it increasingly tightens the camming action of the pivot arms and consequently creates mounting tensile force on the screws. As the tensile capacity of the screws is surpassed, they shear off, thereby releasing the setting tool and workstring for tripping uphole. The whipstock is maintained in an "as set" position by the diverging angle of the pivot arms; camming in opposite directions makes the assembly extremely stable. The whipstock is then permanently set in the hole.

One of the important advantages of the arrangement is that due to the very narrow run-in cross section, the permanent whipstock of the invention can be run-in through a restricted bore and due to the large expansion capability of the device, can still be opened and set in a standard sized hole further downhole. Inflatable anchoring systems have been used but usually locate the deflection surface in a centralized position leaving unacceptable cavities around the whipstock in which a mill could become lodged.

The above-discussed and other features and advantages of the present invention will be appreciated and understood by those skilled in the art from the following detailed description and drawings.

BRIEF DESCRIPTION OF THE DRAWINGS

Referring now to the drawings wherein like elements are numbered alike in the several FIGURES.

DETAILED DESCRIPTION OF THE PREFERRED EMBODIMENT

Figure 1:
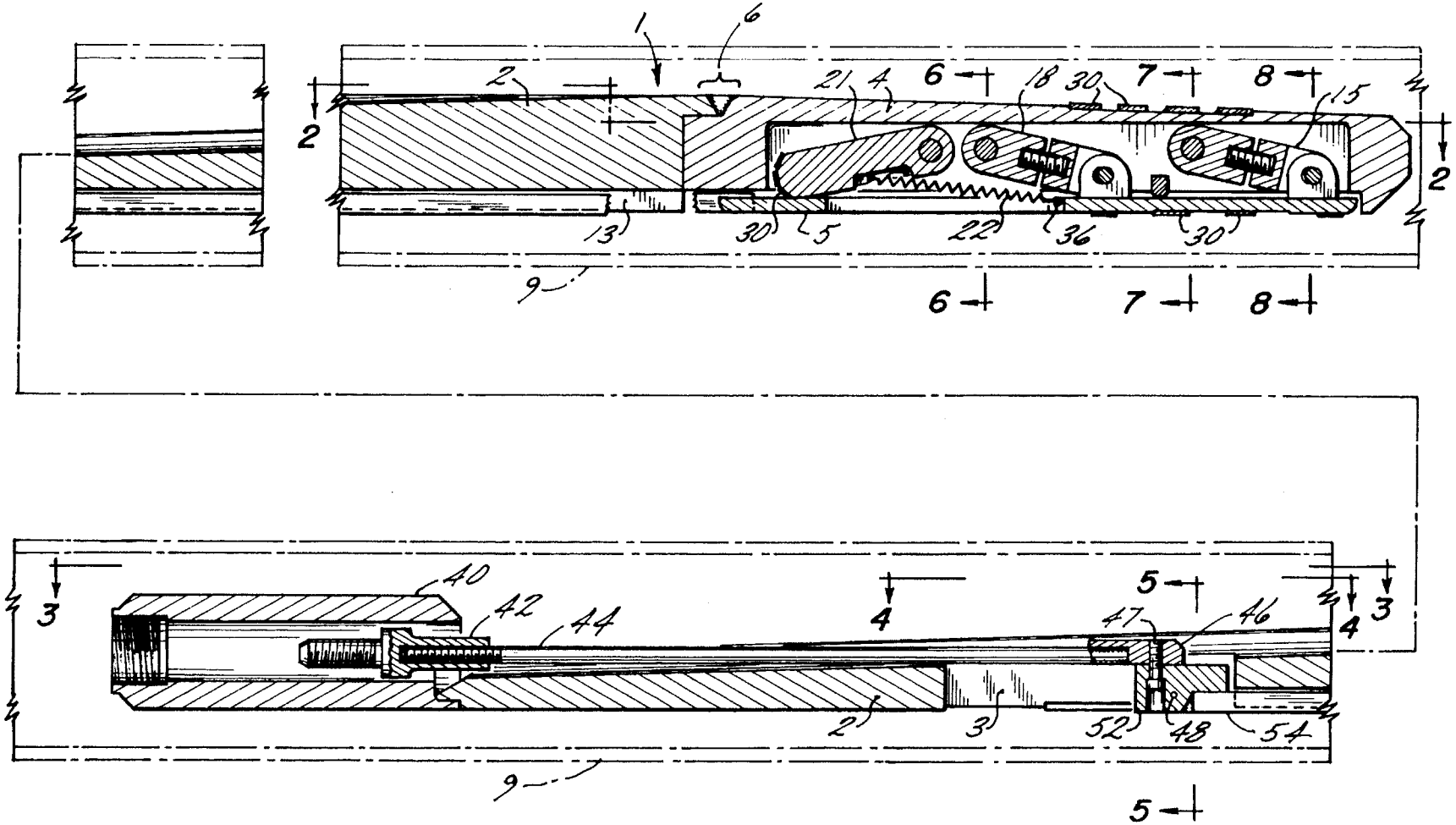
FIG. 1 is an elevation view of the permanent whipstock assembly of the invention in the run-in position.
Figure 1A:
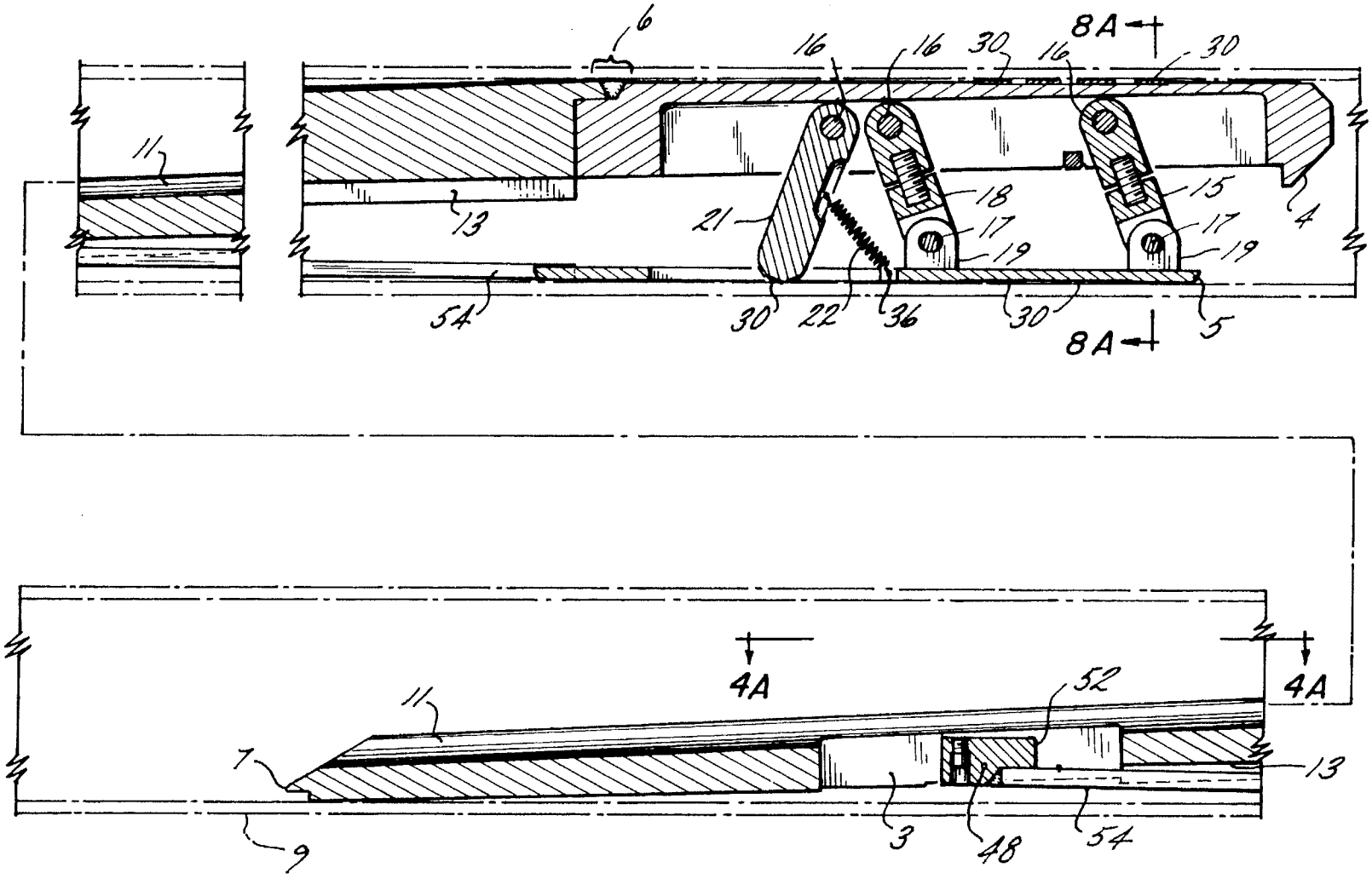
FIG. 1A is an elevation view of the permanent whipstock assembly in the set position.
Figure 2:
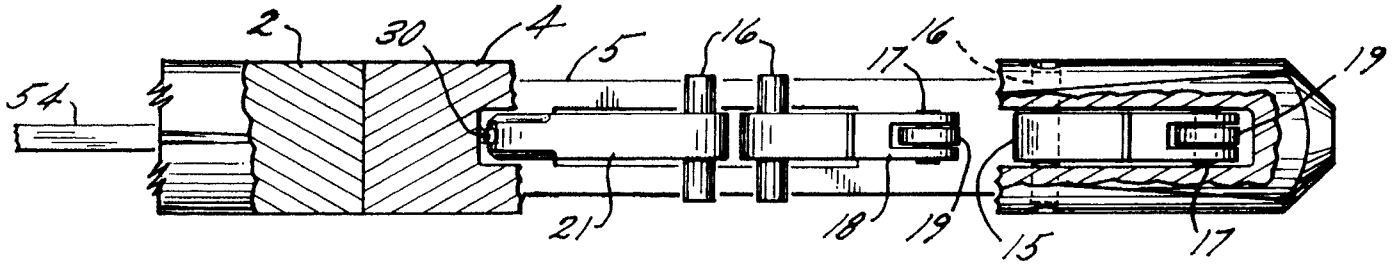
FIG. 2 is a plan view of the slip pad housing and pivot arms.

Referring to FIGS. 1 and 1A, the permanent whipstock assembly is understood by one of skill in the art to be a whipstock housing 1 with a tapered whipstock 2 having pivot arms 15, 18 and 21 for setting and holding (by camming action) the whipstock housing 1 at a preselected position within a wellbore casing 9. Several particular arrangements make the disclosed whipstock extremely effective. The embodiment described in detail hereunder is particularly suited for a cased wellbore of a 6.25 inches inside dimension, however, clearly the invention is useable in other sized cased wellbores with minor modifications.

Whipstock housing 1, as seen in elevation view in FIG. 1, is tapered axially both uphole and downhole of a zone of attachment 6 between whipstock 2 and slip pad housing 4. As can be easily observed in drawing FIGS. 1 and 1 A, whipstock 2 steadily increases in elevational dimension from the uphole end of whipstock housing 1 to the zone of attachment 6 between whipstock 2 and slip pad housing 4.

At this juncture, however, a taper begins again but in the opposite direction. More specifically, slip pad housing 4 steadily decreases in elevational dimension beginning at the zone of attachment 6 and extending to the downhole end of slip pad housing 4, which is also the downhole end of whipstock housing 1. The taper of slip pad housing 4 creates a lever action of the whipstock housing 1 such that as the downhole end of the assembly is pressed into contact with the one side borehole casing 9, the uphole end of the assembly is pressed into contact with the opposite side of the borehole casing 9. This is advantageous as it ensures that the uphole end of whipstock housing 1 does not allow for gaps in which the subsequently tripped drilling tool might become jammed.

Referring now to FIGS. 1, 1A, 2, 5–8A, 11 and 12, the whipstock housing 1 is supported in a preselected position within a borehole by a series of camming devices. In the most preferred embodiment, three camming pivot arms are contemplated. It will be understood that three arms is not critical, but is preferred for effective support and cost considerations. The most preferred embodiment includes a long pivot arm 15, a short pivot arm 18 and a pivot arm wedge 21. As is illustrated in the drawings long pivot arm 15 and short pivot arm 18 are both of a three piece construction. Each arm is severed into two similar pieces; each arm is then reassembled with the severed halves via a swiveling means. Preferably the swiveling means is a threaded insert. This ensures that arms 15, 18 will not bind upon encountering irregular forces downhole; rather they will swivel and continue to operate properly. Pivot arm wedge 21 is not so arranged as there is no need for it to swivel. Wedge 21 is connected to the apparatus of the invention at only one end and will find its own equilibrium against casing 9.

Long pivot arm 15 and short pivot arm 18 are pivotally mounted in the slip pad housing 4 on hinge pins 16 which preferably are of a 0.75 inch diameter, however a range of from about 0.25" to about 1.5" in diameter would be acceptable. Using these hinge pins 16 as a reference point, the long and short pivot arms 15, 18 extend from the hinge pins 16 in a generally downhole direction and in a direction generally opposed to the whipstock 2 taper. With one end of the subject pivot arms 15, 18 being connected to hinge pins 16, the other ends of these pivot arms are connected to slip pad assembly 5 via hinge pins 17 through clevis plates 19; clevis plates 19 are welded or otherwise fastened to slip pad 5. Hinge pins 17 may be in the range of about 0.25" to about 1.5" in diameter but are most preferably 0.50 inches in diameter. All hinge pins 16 and 17 are preferably welded in place but may be fixedly attached in other conventional arrangements.

It should also be noted that the hinge pin holes in clevis plates 19 are not circular but are of an elongated oval shape. This arrangement is beneficial to the strength of the assembly since it allows for all of the load in the pivot arms 15, 18 to be borne by slip pad 5; hinge pins 17 do not bear any significant load.

The third pivot arm, pivot arm wedge 21, is pivotally connected to slip pad housing 4 on a pin 16 in a manner similar to arms 15, 18, however, using this pin as a reference point, pivot arm wedge 21 extends generally in an uphole direction and away from the slip housing 5 taper. Pivot arm wedge 21 advantageously contains a means to engage one end of an extension spring 22 which then is connected on its other end to extension spring pin 36 on slip pad 5. On an end opposite hinge pin 16, pivot arm wedge 21 contains at least one carbide insert 30, and more preferably three carbide inserts 30, to provide frictional engagement with casing 9 when pivot arm wedge is in the set position (i.e., extending through an opening in slip pad 5).

Figure 9:
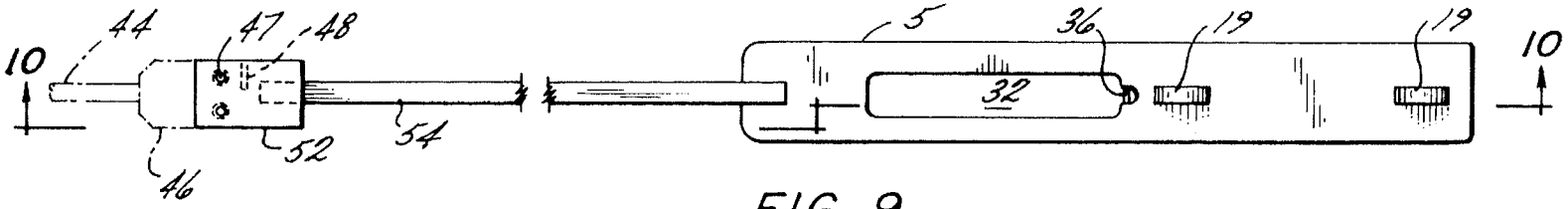
FIG. 9 is a plan view of the slip pad, setting bar an lower shear block.
Figure 10:
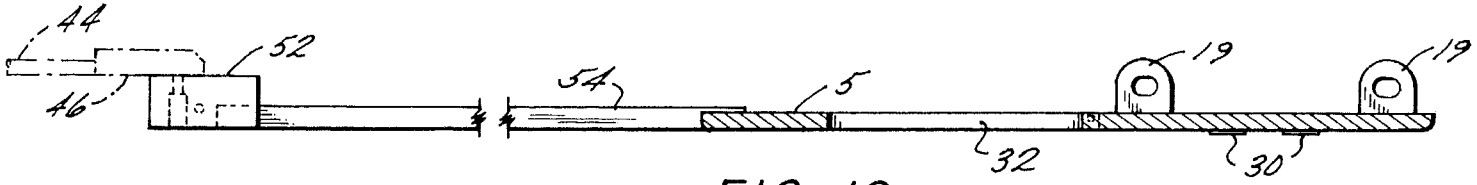
FIG. 10 is a partial cross-section view of FIG. 9 taken along section line 10—10.
Figure 11:
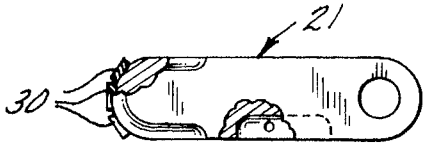
FIGS. 11 and 12 are plan and side views, respectively, of the pivot arm wedge.
Figure 12:
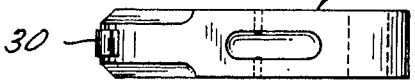

Slip pad 5 as illustrated in FIGS. 9 and 10, comprises an elongated rectangular member with carbide inserts 30 for frictional engagement with the casing 9. The inserts 30 provide for greater frictional adhesion than the slip pad 5 itself. Individual inserts may be placed in any array desired. Slip pad 5 also includes a wedge opening 32 uphole from the inserts 30. Wedge opening 32 is positioned such that pivot arm wedge 21 may pass through the opening to contact casing 9. Included at the downhole most edge of wedge opening 32 is extension spring pin 36 which is fixedly attached to slip pad 5. Spring 22 is anchored between this pin and pivot arm wedge 21 to assist in moving pivot arm wedge into the set position.

Upon actuation of the setting process, slip pad 5 is pulled in an uphole direction. This movement causes long and short pivot arms 15, 18 to pivot outwardly from slip pad housing 4, effectively increasing the distance of slip pad 5 from slip pad housing 4; thus increasing the diametrical dimensions of the whipstock housing so that it will turn in the borehole. As this distance increases, the tapered side of slip pad housing 4 is forced into contact with casing 9. Consequently, because of the shape of the whipstock housing 1, the taper of slip housing 4 ensures that the uphole end of whipstock 2 is in firm contact with the opposite side of casing 9, generally diametrically opposed sides are indicated.

As slip pad 5 is pulled uphole and long and short pivot arms 15, 18 are pivoted into place, pivot arm wedge 21 is pivoted in a direction opposite arms 15, 18. This pivoting action of wedge 21 is augmented, as stated above, by an extension spring 22. Pivot arm wedge 21 continues to pivot from its run-in position shown in FIG. 1 to an extended position shown in FIG. 1A wherein the end of wedge 21 opposite hinge pin 16 is disposed within wedge opening 32. This provides pivot arm wedge 21 access to casing 9. The purpose of pivot arm wedge 21 is to maintain whipstock housing 1 in an "as set" position. This end is achieved because pivot arm wedge 21 is cammed in an opposed direction to long and short pivot arms 15, 18. Therefore the whipstock housing 1 cannot move uphole or downhole. Moreover, vibration does not loosen the pivot arms, rather it has been found that vibrations from workstrings and drillstrings tripped downhole actually cam the pivot arms more tightly. Indeed, experimental settings have actually revealed the carbide inserts 30 on slip pad 5 and on slip pad housing 4 to become embedded into casing 9 up to 1/16 of an inch.

At the uphole most portion of whipstock housing 1 a setting sleeve 40 is positioned. Setting sleeve 40 is adapted to be operatively connected at the uphole end to a conventional setting tool (not shown) and at the lower end to an adapter 42 and a lip 7 of whipstock 2. Adapter 42 is connected to an upper setting bar 44 which in turn is connected to an upper shear block 46. Upper shear block 46 is fastened to lower shear block 52 by any fastening means, but preferably is fastened by tack welding and machine screws 47. Lower shear block 52 is connected to lower setting bar 54 which is connected to slip pad 5.

Figure 3:
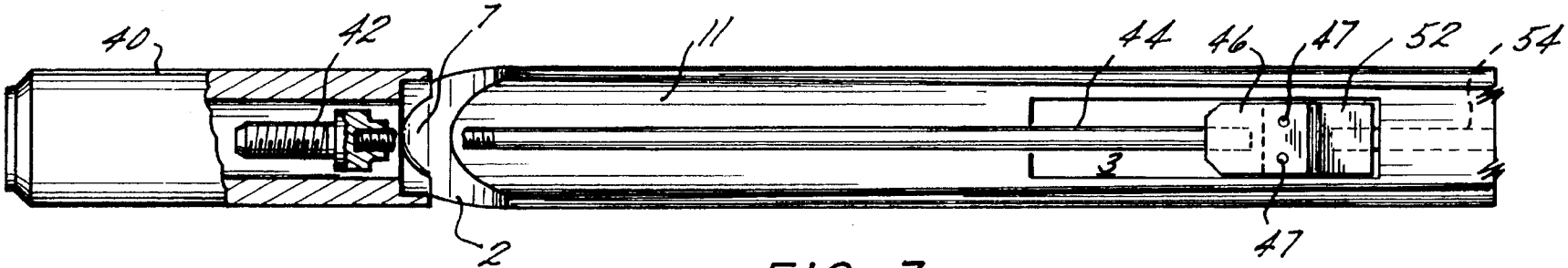
FIG. 3 is a plan view of the whipstock shear block assembly upper setting bar adapter and setting sleeve of the invention.
Figure 8:
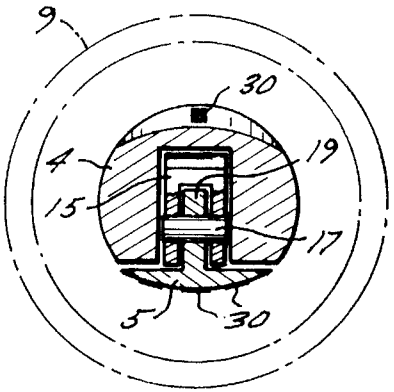
FIG. 8 is a cross section view of FIG. 1 taken along section line 8—8.
Figure 8A:
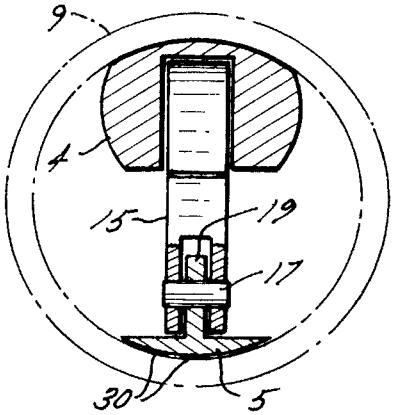
FIG. 8A is a cross section view of FIG. 1 taken along section line 8A—8A.
Figure 7:
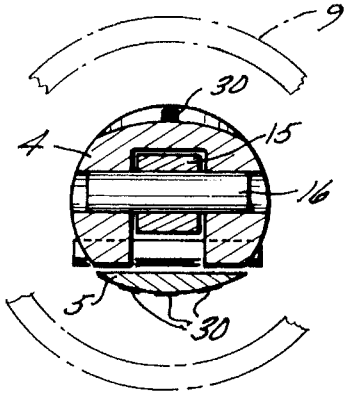
FIG. 7 is a cross section view of FIG. 1 taken along section line 7—7.
Figure 6:
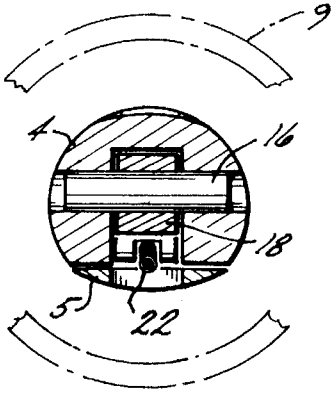
FIG. 6 is a cross section view of FIG. 1 taken along section line 6—6.
Figure 5:
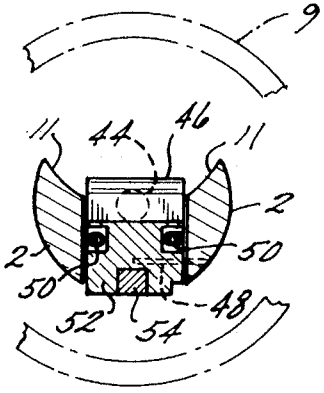
FIG. 5 is a cross section view of FIG. 1 taken along section line 5—5.
Figure 4:
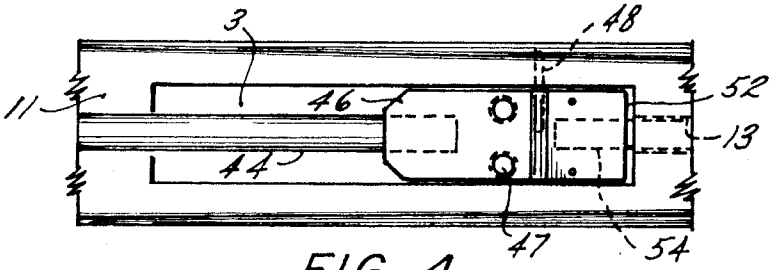
FIG. 4 is a plan view of the shear block assembly of the invention in the run-in position.
Figure 4A:
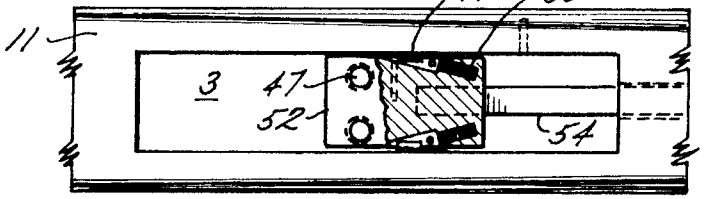

As can be ascertained from FIGS. 1 and 3, setting sleeve 40 is axially aligned with whipstock housing 1. The centrally mounted adapter 42 and upper setting bar 44 are, therefore, located adjacent the tapered trough 11 in the whipstock 2. Since the slip pad 5 is located diametrically opposite the trough 11, the setting assembly preferably passes through whipstock 2. Provision is made therefore by shear block assembly opening 3, illustrated in FIGS. 4 and 4*a*. Opening 3 passes from trough 11 completely through whipstock 2 to whipstock/casing surface 8. The opening is dimensioned preferably in the shape of a rectangle closely approximating the lateral edge dimension of lower shear block 52 and providing for relatively extended movement in parallel with said lateral edges. Lower shear block 52 is oriented within the opening so the casing surface of block 52 is flush with the casing side 8 of whipstock 2; a channel 13 is provided in the casing side 8 of whipstock 2 opposite from trough 11, to receive lower setting bar 54. The channel 13 continues for the length of whipstock 2 beginning from shear block assembly opening 3 and ending at slip pad 5.

The setting motion of the above listed parts is initiated at a preselected time by a heat charge exploding within the setting tool. The charge heats oil contained in the setting tool and actuates a piston connected to the setting sleeve 40 of the invention. As tension in the components builds a shear pin 48, which previous to shearing extended from within lower shear block 52 to whipstock 2 to maintain the slip pad 5 and pivot arms 15, 18 and 21 in the run-in position, is sheared. Once shear pin 48 shears, the setting assembly begins moving in the uphole direction, slip pad 5 moves uphole with these components and moves laterally as well, against the casing 9, because of long and short pivot arms 15, 18. As the overall diameter of the slip pad housing 4 and slip pad 5 grows the whipstock housing 1 is firmly wedged within the cased wellbore at a predetermined location.

As long and short pivot arms 15, 18 pivot to a more perpendicular position relative to the axis of the whipstock housing 1, pivot arm wedge is drawn from the run-in position toward the extended slip pad 5. The drawing action is accomplished by extension spring 22 which, as noted above, is mounted on slip pad 5 at one end and on pivot arm wedge 21 at the other. As slip pad 5 is pushed away from slip pad housing 4, extension spring 22, attached on one end to pivot arm wedge 21 and on the other to slip pad 5, contracts. This assists the pivoting action of pivot arm wedge 21 to pivot into wedge opening 32 and into contact with casing 9. Further pulling in the uphole direction by the setting assembly sets pivot arm wedge 21 firming into casing 9. With long and short pivot arms 15, 18 and pivot arm wedge 21 in opposing frictional relationship with casing 9 the whipstock housing 1 is set.

The set position of whipstock housing 1 is ensured both by simple principles of physics and by mechanical assistance from lower shear block 52. Lower shear block 52 is equipped to maintain slip pad 5 in an "as set" position by incorporating in block 52 at least one, and preferably a pair of slip locks 49. Slip locks 49 include gripping means adapted to slide within shear block assembly opening 3 in the uphole direction and grip in the downhole direction. Slip locks 49 are equipped with biasing means 50 to bias the slip locks 49 toward engagement with the defining structure of shear block assembly opening 3. Upon engagement therein the lower shear block is prevented from moving in the downhole direction. Consequently slip pad 5 cannot move in the downhole direction and thus the whipstock housing remains in an "as set" position.

After whipstock housing 1 is set, the setting assembly desirably continues to pull uphole. That creates mounting tensile forces on all of the components. The predetermined "weak link" in the setting assembly of the preferred embodiment chain is machine screws 47. Machine screws 47 are engineering to hold safely under a tensile force of approximately 10 to 15 thousand pounds but will shear off between 17 and 18 thousand pounds. This is desirable in order to disconnect and retrieve setting sleeve 40, adapter 42, upper setting bar 44 and upper shear block 46. Once these parts are disconnected and tripped uphole, whipstock 2 provides a continuous virtually obstruction free (lower shear block 52 is flush with trough 11 ) tapered path to force a drillstring toward casing 9 for drilling a lateral or avoiding an obstruction.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A permanent whipstock assembly comprising:

a) an elongated whipstock housing including a whipstock and a slip pad housing;

b) a plurality of pivot arms pivotally connected to said slip pad housing;

c) a slip pad pivotally connected to at least one of said plurality of pivot arms; and d) a setting assembly connected to said slip pad for drawing said slip pad uphole to set said plurality of pivot arms thus biasing said slip pad, said slip pad housing and said whipstock against a casing in a wellbore wherein the permanent whipstock is located, whereby said whipstock assembly is permanently secured within said wellbore.

2. A permanent whipstock assembly according to claim 1 wherein said whipstock includes two surfaces, a first surface having a tapered trough which is relatively deep at the uphole end of the whipstock and relatively shallow at the downhole end of the whipstock in which the trough is located, and a second major surface adjacent a casing of a borehole, said whipstock including an opening extending from the first surface to the second surface of the whipstock.

3. A permanent whipstock assembly according to claim 2 wherein the opening is of a rectangular dimension.

4. A permanent whipstock assembly according to claim 1 wherein said plurality of pivot arms is three pivot arms.

5. A permanent whipstock assembly according to claim 4 wherein two of said three pivot arms are swiveling pivot arms.

6. A permanent whipstock assembly according to claim 1 wherein the slip pad includes a clevis disposed thereon to engage said at least one pivot arm.

7. A permanent whipstock assembly according to claim 1 wherein the slip pad further includes at least one carbide insert for increased frictional engagement within a casing of a wellbore.

8. A permanent whipstock assembly according to claim 7 wherein at least one carbide insert protrudes from a face of the slip pad by approximately 1/16 inch.

9. A permanent whipstock assembly according to claim 1 wherein said slip pad includes an opening extending in a longitudinal direction therein to accommodate through passage of a pivot arm wedge in order for said wedge to engage a wellbore casing.

10. A permanent whipstock assembly according to claim 1 wherein said plurality of pivot arms includes a long pivot arm and a short pivot arm wherein said long pivot arm and short pivot arm are swivelable at a central cross sectional region of each pivot arm.

11. A permanent whipstock assembly according to claim 10 wherein said swivel is a pin extending into an axial bore in each pivot arm.

12. A permanent whipstock assembly according to claim 11 wherein said axial bore is threaded.

13. A permanent whipstock assembly according to claim 1 wherein the setting assembly further includes a lower setting bar connected to the slip pad, a lower shear block connected to the lower setting bar, and upper shear block affixed to said lower shear block, and upper settings connected to said upper shear block by structure susceptible to being sheared at a predetermined force, said upper shear block being connected to an upper setting sleeve, said upper setting sleeve being adapted for connection to a conventional setting tool.

14. A permanent whipstock assembly according to claim 13 wherein said upper and lower shear blocks form an assembly which is positioned within an elongated rectangular opening through said whipstock and extending from a tapered trough of said whipstock to an opposite surface of said whipstock.

15. A permanent whipstock assembly according to claim 14 wherein said upper and lower shear block assembly is slideable in the uphole direction within said opening.

16. A permanent whipstock assembly according to claim 13 wherein said lower shear block includes at least one slip lock disposed in at least one lateral opening thereon which prevents movement of the lower shear block in the downhole direction.

17. A permanent whipstock assembly according to claim 13 wherein said structure susceptible to being sheared comprises at least one bolt having a shear stability of approximately 10–15 thousand pounds.

18. A permanent whipstock assembly according to claim 2 wherein said whipstock includes a channel beginning at said opening and extending downhole to the slip pad housing along the casing surface of the whipstock.

19. A permanent whipstock assembly according to claim 1 wherein said whipstock, at the uphole end thereof includes a lip for engagement within a setting sleeve.

20. A shear block assembly for use with a camming whipstock assembly comprising a lower shear block and an upper shear block said lower shear block being shearably fastened by a fastening arrangement to said upper shear block said shear block assembly being disposed within an opening defined by said whipstock.

21. A permanent whipstock assembly according to claim 20 wherein said lower shear block includes a shear pin extending from within a bore in a lateral surface of the lower shear block to a bore within the whipstock for preventing movement of the lower shear block during run-in of the whipstock assembly to a borehole.

22. A shear block assembly according to claim 21 wherein the shear pin prevents movement of an entire setting assembly including: an upper setting bar which is connected to upper shear block, the lower shear block, being connected to the upper shear block and at an opposed surface of the lower shear block to a lower setting bar, said lower setting bar being fixedly attached to a slip pad, said slip pad being pivotally attached to at least one pivot arm said at least one pivot arm being attached to said whipstock assembly.

23. A shear block assembly according to claim 22 wherein the shear pin is shearable by a tensile force applied to said setting assembly.

24. A shear block assembly according to claim 23 wherein the tensile force applied by the setting assembly is on the order of about 17–18 thousand pounds.

25. A shear block assembly according to claim 23 wherein upon shearing the shear pin the at least one pivot arm is rotated outwardly from the whipstock assembly such that the whipstock assembly is cammed in place at a preselected depth in a borehole.

26. A shear block assembly according to claim 25 wherein subsequent to said whipstock being cammed in place said fastening arrangements is sheared whereby said upper shear block and said lower shear block are separated.

27. A shear block assembly according to claim 2 wherein said slip pad housing includes a taper having a hyperbolic relationship to said whipstock taper, the hyperbola being concave toward said at least one pivot arm.

28. A method of setting a permanent whipstock at a preselected position within a cased borehole comprising the steps of:

a) running in a permanent whipstock assembly, including a slip pad housing having at least one camming pivot arm attached to the slip pad housing, a slip pad attached to the at least one pivot arm, the slip pad being attached on an uphole end to a downhole end of a lower setting bar, an uphole end of said setting bar being attached to a lower shear block, said lower shear block being shearably fastened by a fastening arrangement to an upper shear block which is connected to an upper setting bar;

b) generating a tensile force within the assembly sufficient to shear a shear pin in the lower shear block so that a setting assembly begins to rotate the at least one pivot arm, thus moving the slip pad further from the slip pad housing and increasing the diametrical dimension of the whipstock assembly in the region of the slip pad housing and slip pad, so that the dimension is equivalent to an inner diameter of the cased borehole so that the at least one pivot arm is set;

c) increasing tensile force upon the assembly until the fastening arrangement fastening the upper shear block and the lower shear block shears.

29. A method according to claim 28 wherein the at least one pivot arm is three pivot arms wherein two of three are located downhole of the third pivot arm and wherein the two downhole pivot arms extend from the slip pad housing in a generally downhole direction whereas the third pivot arm extends from the slip pad housing in a generally uphole direction.

30. A method according to claim 29 wherein the two downhole pivot arms are swivelable about a cross section of each pivot arm.

31. A method according to claim 28 wherein the lower shear block includes at least one slip lock for preventing the lower shear block from moving downhole within a rectangular through-bore in the whipstock wherein the lower shear block is disposed.

32. A method according to claim 28 wherein the fastening arrangement shears at a tensile force of about 17 to 18 thousand pounds.

33. A method according to claim 31 wherein said at least one slip lock is a pair of slip locks disposed in opposite lateral surfaces of the lower shear block.

34. A method according to claim 31 wherein said at least one slip lock is biased into contact with lateral edges of the whipstock shear block assembly opening.

* * * * *